United States Patent [19]

Ruegg, Sr.

[11] 4,280,474

[45] Jul. 28, 1981

[54] HEAT HUGGER

[76] Inventor: Harvey L. Ruegg, Sr., 9020 S. Hosmer, D-54, Tacoma, Wash. 98444

[21] Appl. No.: 170,694

[22] Filed: Jul. 21, 1980

Related U.S. Application Data

[63] Continuation-in-part of Ser. No. 82,700, Oct. 9, 1979.

[51] Int. Cl.[3] ..... F24B 7/00

[52] U.S. Cl. ..... 126/121; 126/131; 126/141; 126/286; 237/51

[58] Field of Search ..... 126/121, 131, 141, 140, 126/138, 123, 197, 192, 286, 290, 295; D23/94; 237/51; 49/365

[56] References Cited

U.S. PATENT DOCUMENTS

| | | | |
|---|---|---|---|
| 41,019 | 12/1863 | Randolph | 126/131 |
| 905,140 | 12/1908 | Biermann | 126/121 |
| 3,866,595 | 2/1975 | Jones | 126/131 X |
| 3,998,203 | 12/1976 | Jensen | 126/286 X |
| 4,003,362 | 1/1977 | Lener | 126/121 |
| 4,026,263 | 5/1977 | Boyd | 126/121 |
| 4,059,090 | 11/1977 | Shaw | 126/121 |
| 4,095,581 | 6/1978 | Billmeyer et al. | 126/121 |
| 4,166,444 | 9/1979 | Martenson | 126/121 |
| 4,170,218 | 10/1979 | Hartley | 126/121 |
| 4,174,701 | 11/1979 | Gneiting | 237/51 X |
| 4,177,793 | 12/1979 | Johnson | 126/121 |
| 4,186,719 | 2/1980 | Dalsin | 126/143 |
| 4,192,458 | 3/1980 | Pinnock et al. | 237/51 |
| 4,196,715 | 4/1980 | Shaw | 126/121 |

FOREIGN PATENT DOCUMENTS

| | | | |
|---|---|---|---|
| 999794 | 11/1976 | Canada | 126/121 |
| 2260275 | 6/1973 | Fed. Rep. of Germany | 126/121 |
| 2632056 | 1/1978 | Fed. Rep. of Germany | 126/121 |
| 1314 | of 1861 | United Kingdom | 126/121 |
| 22519 | of 1907 | United Kingdom | 126/141 |
| 223937 | 12/1925 | United Kingdom | 126/131 |

OTHER PUBLICATIONS

Popular Science, "Bill Well's Fireplace Under Glass", p. 111+, Mar. 1976.

*Primary Examiner*—Samuel Scott
*Assistant Examiner*—Randall L. Green

[57] ABSTRACT

A fireplace insert is disclosed which will efficiently heat the interior of a structure, enable control of fuel burn rate and temperature of heated air directed into the interior structure, and facilitate circulation of the heated air through the interior rooms of the structure via pressure differential created by the forced-air flow through the insert. The unit includes an air-tight cover to the interior fireplace opening, a continuous heat exchanger across the top of the fireplace combustion chamber which continues down parallel to the rear of the fireplace combustion chamber and opens rearward to the outside air dual intake chamber which is equipped with a variable speed fan. The interior end of said heat exchanger mates with the forced air outlet in the airtight cover to the fireplace opening. Said outside air dual intake chamber is equipped with a screen on the end opening to the outside of the structure, a butterfly damper between the fan and an intake shield adjacent to the fireplace combustion chamber, said shield having an air flow passage extending along the lower face of the combustion chamber and air flow exhaust into the front of the combustion chamber. The variable speed fan, which controls the volume of air passing through the system, draws outside air and passes it under pressure into the dual chambers. The upper chamber leads to the heat exchanger unit and the lower chamber opens to the airflow passage under the combustion chamber. The butterfly valve, in the lower chamber, controls the burn rate of the fuel in the combustion chamber of the fireplace. This process yields a positive air pressure in the interior room created by the heated air, so that the warm air will pass freely into rooms adjacent to the one in which the fireplace is located.

10 Claims, 10 Drawing Figures

HEAT HUGGER

BACKGROUND OF THE INVENTION

This application is a continuation in part of that certain application filed Oct. 9, 1979, under serial number 6/082,700, upon which no office action has as yet been taken.

FIELD OF INVENTION

This invention relates to an improved fireplace insert which optimizes the transfer of heat, generated by traditional fireplace operation, to the interior dwelling structure and enables the control of not only the flow of heated air into the interior dwelling, but also the control of the combustion rate of the fuel in the fireplace combustion chamber. In particular, this invention relates to an insert for standard fireplace construction which adjusts to the inner parameters of the fireplace and seals off the combustion chamber from the interior structure, so that no air or exhaust from the combustion chamber escapes into the interior of the dwelling structure. However, this invention draws outside air from the rear of the fireplace, directing a controlled amount into the combustion chamber and another amount through the heat exchanger system and into the interior of the dwelling structure.

DESCRIPTION OF PRIOR ART

It is known that outside air can be directed from an opening in the rear of a fireplace into a hollow heat exchanger traversing the rear and upper faces of the fireplace combustion chamber and emptying into the interior dwelling structure. It is also known that the outside air can be drawn in by a fan and utilized for both the heat exchanger and the fireplace combustion chamber.

However, the existing devices do not provide for control of the burn rate nor the circulation of heated air throughout the interior structure. Existing devices do not allow for insertion in existing fireplace units without extensive and costly reconstruction. In addition, no existing devices have fully complied with the standards for factory-built fireplaces, ULC S610/UL127, which standards were found to have been met by the instant invention by Warnack Hersey Professional Services, Ltd., on June 1, 1980.

The applicant has commissioned a patent search for conflicting prior art through the firm of Schlesinger, Arkwright, Garvey & Dinsmore, and cites the following United States patents as having been considered and found not conflicting for the reasons indicated.

| U.S. PAT. NO. | DATE | INVENTOR | CLASS |
|---|---|---|---|
| 905,140 | 12/1/1908 | H. A. Bierman | 126/131 |

The Bierman patent discloses the utilization of a hollow, fully enclosed heat exchanger designed to heat air from an external source by passing it through a fireplace combustion chamber and directing said heated air into the same or another room. The Bierman patent does not provide for (1) forced air heating through the exchanger, (2) use of external air in the combustion chamber of the fireplace, nor (3) control of the burn rate and air flow through the heat exchanger. The use of a tubular heat exchanger in the combustion chamber does not take advantage of the full capacity of said combustion chamber to heat air for the dwelling structure. The Bierman patent is not adjustable for ease of installation in various fireplace forms and does not prevent the escape of interior air from the dwelling through the combustion chamber and out the chimney. All of these deficiencies of the Bierman patent are satisfied by the Ruegg invention.

| U.S. PAT. NO. | DATE | INVENTOR | CLASS |
|---|---|---|---|
| 1,681,499 | 3/14/27 | H. H. Walters | 126/121 |

The Walters patent discloses the transfer of outside air from the rear of the fireplace; through a hollow heat exchanger within the combustion chamber of the fireplace and into the interior of the dwelling structure. The Walters patent does not provide for forced-air flow through the heat exchanger nor control of the rate of combustion via restriction of outside air to the combustion chamber. It does not provide against escape of air from the interior of the dwelling structure through the combustion chamber and is not adjustable for easy insertion into existing fireplaces. All of these deficiencies are satisfied by the Ruegg invention.

| U.S. PAT. NO. | DATE | INVENTOR | CLASS |
|---|---|---|---|
| 3,998,203 | 12/21/76 | P. J. Jensen | 126/131 |

The Jensen patent discloses a standard heat exchanger utilizing outside air in conjunction with a standard fireplace, which is equipped with a dual control flange so that heated air from the heat exchanger may be directed (vented) outside the interior dwelling structure when fireplace is in use in warm weather. The Jensen patent does not provide for control of the burn rate via restriction of outside air to the combustion chamber, nor prevent the escape of interior air through the combustion chamber, nor is it adjustable for insertion in fireplaces of varying sizes. All of these deficiencies are satisfied by the Ruegg invention.

| U.S. PAT. NO. | DATE | INVENTOR | CLASS |
|---|---|---|---|
| 4,059,090 | 11/22/77 | W. S. Shaw | 126/121 |

The Shaw patent discloses a free-standing fireplace unit which provides a supply of forced air, from outside the structure, to the combustion chamber and the heat exchanger area around the combustion chamber. The Shaw patent is not designed for insertion into existing fireplaces, does not prevent escape of air from the interior of the structure through the combustion chamber, and does not effectively segregate the exhaust air, from the combustion chamber, from the air passing through the heat exchanger into the interior dwelling structure. It does not provide a positive air pressure in the interior room to facilitate circulation of heated air within the structure. All of these deficiencies are satisfied by the Ruegg invention.

| U.S. PAT. NO. | DATE | INVENTOR | CLASS |
|---|---|---|---|
| 4,131.106 | 12/26/78 | S. Rusinek, Jr. | 126/121 |

The Rusinek patent discloses the circulation of forced air through tubular cradle in the combustion chamber of a fireplace. There is no provision for control of the burn rate within the fireplace, nor for prevention of the escape of interior air through the combustion chamber, nor for adjustment of the invention to fit fireplaces of various depths. All of these deficiencies are satisfied by the Ruegg invention.

| U.S. PAT. NO. | DATE | INVENTOR | CLASS |
|---|---|---|---|
| Re. 30,043 | 7/14/79 | A. Y. Moncrieff-Yeates | 126/131 |

The Yeates patent discloses a heat exchanger for use in fireplaces which totally occupies the combustion chamber and circulates interior air around the three sides and top and bottom of the combustion chamber, with an additional exchanger channel directing air flow from the back of the combustion chamber to the interior of the dwelling, parallel to the top of the heat exchanger, approximately four-fifths of the way up from the base of the unit.

The Yeates patent does not provide for the use of outside air in the combustion chamber or the heat exchanger; does not prevent escape of interior air through the combustion chamber, and does not provide for control of the burn rate. In addition, it is not adjustable for use in fireplaces of various depths, nor does it provide for forced-air flow through the heat exchanger. All of these deficiencies are satisfied by the Ruegg invention.

Aside from the deficiencies in the prior art, noted above, the key to the utility of the Ruegg invention is that it is inexpensive to manufacture, based upon its standard configuration and adjustability, and installs in existing fireplaces. The unique provision for control of burn rate and volume of air passing through the system enables the user to balance these factors in order to optimize the efficiency of the total system.

OBJECTS AND SUMMARY OF THE INVENTION

Objects

It is therefore a general object of the invention to provide a fireplace insert heat exchanger system, primarily applicable to existing fireplace structures, wherein interior air is not lost through the fireplace combustion chamber and the rate of burn and volume of heated air is readily controllable from the interior face of the system.

It is a specific object of the invention to provide a novel fireplace heat exchanger system which is inexpensive to manufacture and install, so that it can be easily adjusted to fit existing fireplaces of varying depths.

It is a further object of the invention to provide a forced-air heat exchanger system for insertion into existing fireplaces, so that a positive air pressure is maintained in the interior room, immediately adjacent to the fireplace, to facilitate circulation of the heated air into selected adjoining rooms by lowering the air pressure therein.

It is a further object of the invention to provide a fireplace heat exchanger insert which maintains the combustion chamber sealed off from the interior of the dwelling structure while maintaining the esthetic quality of a burning fire when viewed from the interior of the dwelling structure, via transparent, self-closing doors.

It is a further object of the invention to provide a safe means of feeding outside air into the combustion chamber, so as to prevent blow-back through the interior channel.

It is a further object of the invention to provide a positive seal of the system when not in use so as to preclude loss of air from the internal part of the dwelling structure while avoiding the risk of carbin dioxide escaping into the interior of the dwelling structure.

It is a further object of the invention to provide a fireplace insert which satisfies ULC S610 and UL 127 standards where inexpensive heat-tempered ¼" glass set into ¼" flat stock mill steel door frame can be utilized.

BRIEF SUMMARY

A fireplace insert heat exchanger system for application to existing fireplace structures, which is suitable to achieve at least some of the foregoing objectives, comprising an airtight transparent cover for the fireplace opening, into the interior of the dwelling structure, which may be opened via self-closing doors for insertion of fuel into the combustion chamber and which is equipped with a forced-air outlet which smoothly joins to the portion of the two-sided continuous heat exchanger unit which covers the top of the combustion chamber in such a manner as to provide for adjusting the length of said side to accommodate the unit to fireplaces of varying depths. The side of the continuous heat exchanger unit, adjoining the side connected to the forced-air outlet, covers the rear of the combustion chamber and connects rearward into the top of the dual intake chamber which opens to the outside of the fireplace structure. The dual intake chamber is equipped with a variable speed intake fan, abutting the exterior intake screen and rain hood, which vectors outside air, under pressure, through the dual intake chamber into the heat exchanger and into the channel to the combustion chamber, which channel is equipped with a butterfly damper to control the quantity of air into the combustion chamber and thus the rate of burn of the fuel, and through the airflow passage under the combustion chamber, whose outlet directs the air down and to the rear of the combustion chamber, which precludes blowback from the combustion chamber to the intake chamber, the butterfly valve being controlled from the interior face of the burn chamber cover by mechanical linkage. The rear and bottom of the combustion chamber are equipped with removable, corrogated flame guards which extend along its entire rear face.

This invention relates generally to an improvement in an article of manufacture to increase the heating capability of existing fireplaces, while alleviating the possibility of warm air passing from the interior of the dwelling structure through the combustion chamber and chimney of the fireplace, by incorporating a fan, to bring outside air from a tunnel in the rear of the fireplace into the combustion chamber of the fireplace, through a butterfly valve which controls the amount of air to the combustion chamber and thus the rate of burn, and into a heat exchanger which carries the outside air across the rear and top of the combustion chamber and exhausts it under pressure into the interior of the dwelling structure, through an outlet in the airtight cover over the interior face of the combustion chamber, which precludes air from the interior of the dwelling structure from entering the combustion chamber.

The objects of this invention are accomplished and will become apparent from the following detailed description taken in conjunction with the accompanying drawings.

Figure 1:
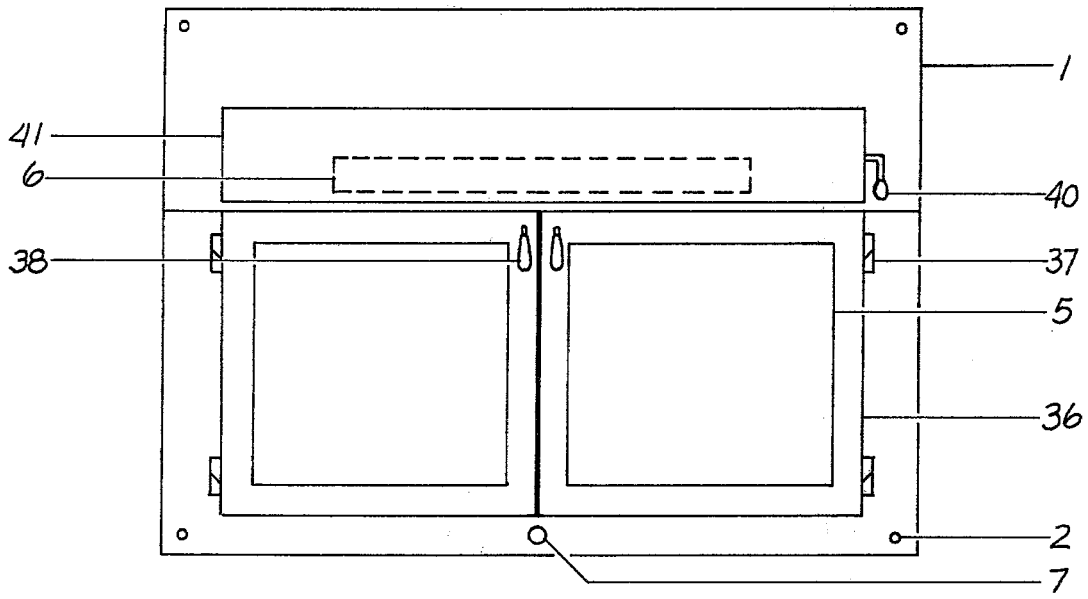
FIG. 1 depicts the face of the fireplace heat exchanger insert viewed from the interior of the dwelling structure.

With direct reference to the drawings, FIG. 1 depicts the unit viewed from the interior of the dwelling structure, showing the frame (1) which extends beyond the dimensions of the combustion chamber (4) of the existing fireplace, equipped with suitable means of fastening said frame to the face of the fireplace, such as with screws, (2), so as to compress the insulation (3) between the borders of the frame and the face of the fireplace, effectively sealing the combustion chamber of the fireplace and precluding the escape of interior air into the combustion chamber (4). Said frame is fitted with heat-tempered ¼" doors (5), with ¼" flat stock mill steel door glass frames (36), set into the frame (1) in such a way as to be airtight when closed, being equipped with self-closing hinges (37) and pull handles (38), through which said doors fuel is added to the combustion chamber (4). Above the doors (5) is provided a forced-air outlet (6), supplied with an impervious and continuous warm air damper (39) across its expanse, manually adjustable via the lever on its end (40), and all covered with a warm air deflector hood (41) which directs the heated air onto the floor of the interior room and precludes inadvertent contact by family members with the hot damper.

Figure 2:
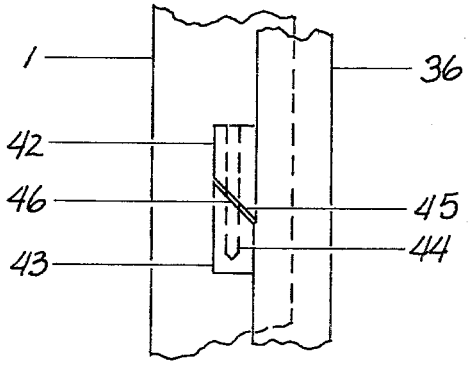
FIG. 2 depicts the self-closing hinge with doors closed.

FIG. 2 depicts one of the self-closing hinges (37) for the left door in the closed position. The hinge itself has three parts: top (42), bottom (43), and rotation hingepin (44). The top half of the hinge (42) is fixedly attached to the ¼" flat stock mill steel door glass frame (36). The bottom half of the hinge (43) is fixedly attached to the interior frame (1) of the unit. The adjoining faces of the top (45) and bottom (46) halves of the hinge are parallel when the door is closed and angle downward from the outside of the frame toward the door at a sufficient angle to facilitate gravitational closing of the doors when open. Through the top and bottom halves of the hinge is vertically set a rotation hingepin (44), which maintains alignment of the two halves when the doors are opening and closing.

Figure 3:
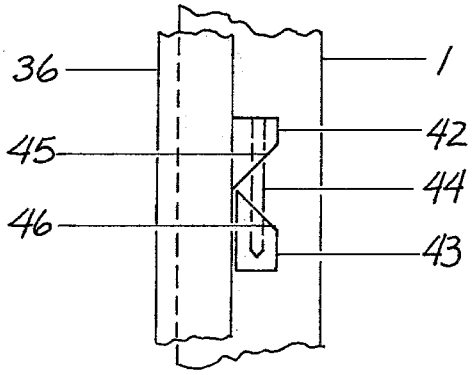
FIG. 3 depicts the self-closing hinge with doors open.

FIG. 3 depicts the hinge (37), shown in FIG. 2, when the door is in the opened position. The angles of the adjoining faces of the top (45) and bottom (46) halves of the hinge are shown with the top half of the hinge (42) rotated 180 degrees. As can be seen, the force of gravity on the door will cause it to rotate so that the adjoining hinge faces parallel each other and thus close the door.

Figure 4:
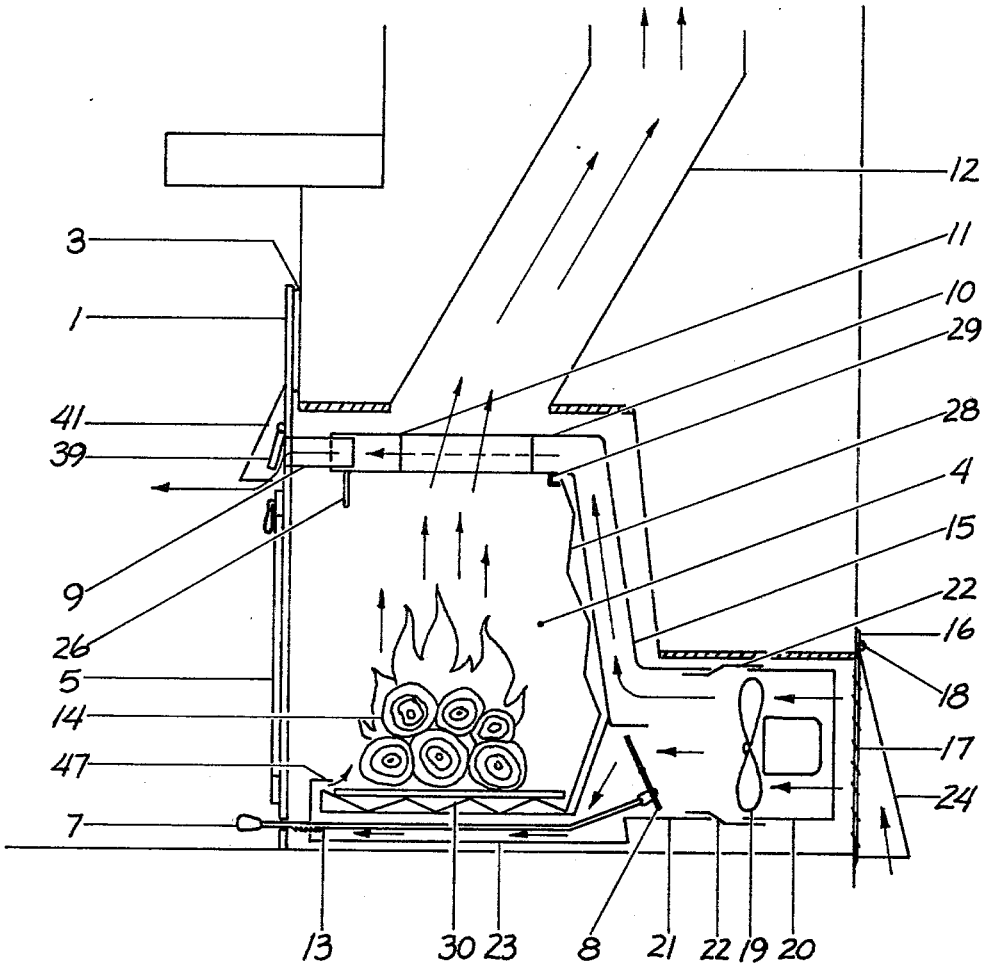
FIG. 4 depicts a cross-sectional side view of the fireplace heat exchanger system installed in a fireplace.

FIG. 4 depicts a cross-sectional side view of the unit installed in an existing fireplace. The interior frame (1) forced-air outlet is equipped with a sleeve (9) which inserts into the heat exchanger section (10) which extends across the top of the combustion chamber (4) so as to allow adjustment of the length of this section to accommodate fireplaces of varied depth. This top section of the heat exchanger (10) has a flame guard (26) extending down into the combustion chamber (4), across its entire width a sufficient distance to preclude flame traveling across the underside of the heat exchanger and impacting the glass doors (5), and an exhaust channel (11) in its center to allow passage of combustion gas from the combustion chamber into the chimney flue (12). The mechanical combustion chamber damper control linkage (13) runs from the control lever (7) across the bottom of the combustion chamber (4) through the combustion airflow passage (23) and is rotatably attached to the bottom of the butterfly valve (8) to adjust the volume of outside air allowed into the combustion chamber (4) and thus pre-heat said air and regulate the burn rate of the fuel (14). The outside air is drawn through the exterior intake cover (16), equipped with a louvered screen (17) and rain hood (24) and securely fastened to the exterior of the fireplace via screws (18), by a variable speed fan (19) into the dual intake chamber (20). This chamber is equipped with a telescoping adjustment sleeve (22) to accommodate fireplace backs of various thicknesses. Outside air passes through the combustion chamber intake channel (21), the volume being regulated by the butterfly valve (8), and through the combustion airflow passage (23) across the flow of the combustion chamber (4) and exhausted rearward across the floor of the combustion chamber (4). The remaining outside air passed through the heat exchanger (10, 15) and is blown through an outlet in the face of the inside frame (1) into the interior of the structure. Extending across and down the entire rear face of the combustion chamber (4) is a removable heat shield (28), horizontally corrogated to provide air chambers between it and the combustion side of the rear heat exchanger (15), being held in place by a similar removable corrogated heat shield (30) equipped with a standard fire grate basket and resting on and covering the top surface of the combustion airflow passage (23), at the bottom and a section of angle iron (29) extending downward from the bottom surface of the top heat exchanger (10) across its width.

Figure 5:
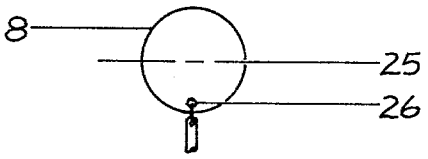
FIG. 5 depicts the butterfly damper.

FIG. 5 depicts the butterfly damper (8) which is located within the combustion chamber intake channel (21) and rotates on its horizontal axis (25) to control the volume of outside air allowed into the fireplace combustion chamber (4) and thus the rate of burn of the fuel. Rotation of said damper (8) is controlled by the damper push-pull adjustment lever (7) on the interior face (1) of the system, via mechanical control linkage (13) which is affixed to the bottom of the butterfly valve (26) and held at a manually selected position by the interface of notches (27) on the lower side of the linkage handle and the metal skin of the interior frame (1).

Figure 6:
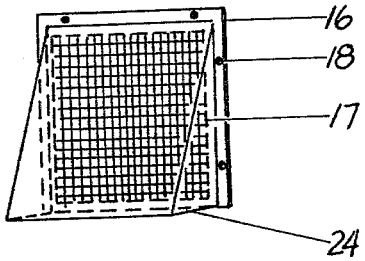
FIG. 6 depicts the exterior intake cover with screen and rain hood.

FIG. 6 depicts the exterior intake cover (16) with louvered screen (17) which is attached over the exterior end of the dual intake chamber (20) with standard screw attachments (18) and covered by a rain hood (24).

Figure 7:
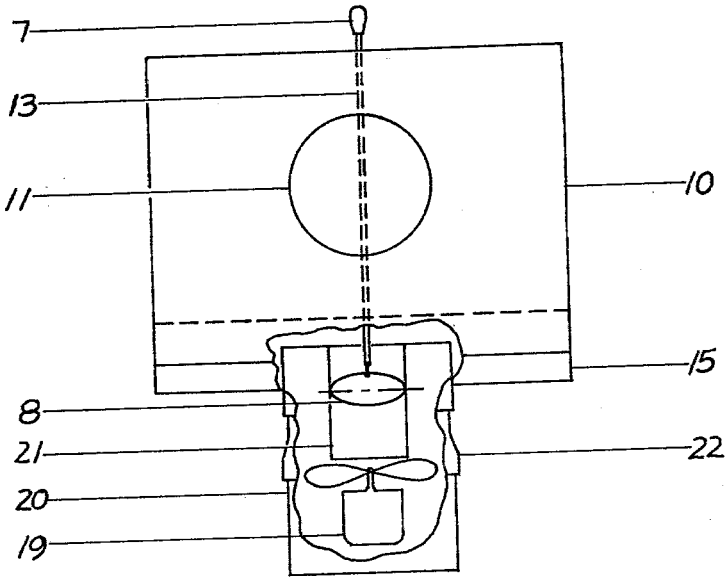
FIG. 7 depicts a cross-sectional top view of the fireplace heat exchanger system, as installed.

FIG. 7 depicts a cross-sectional top view of the fireplace heat exchanger system, as installed, showing the dual intake chamber (20), fan (19), and relationship of the combustion chamber intake channel (21) thereto. The top section of the heat exchanger (10) has an exhaust channel (11) in its center to allow combustion gases to escape from the combustion chamber (4) into the chimney flue (12), the walls of said exhaust channel (11) being airtight so as to preclude mixing of the exhaust gases with the outside air passing through the heat exchanger.

Figure 8:
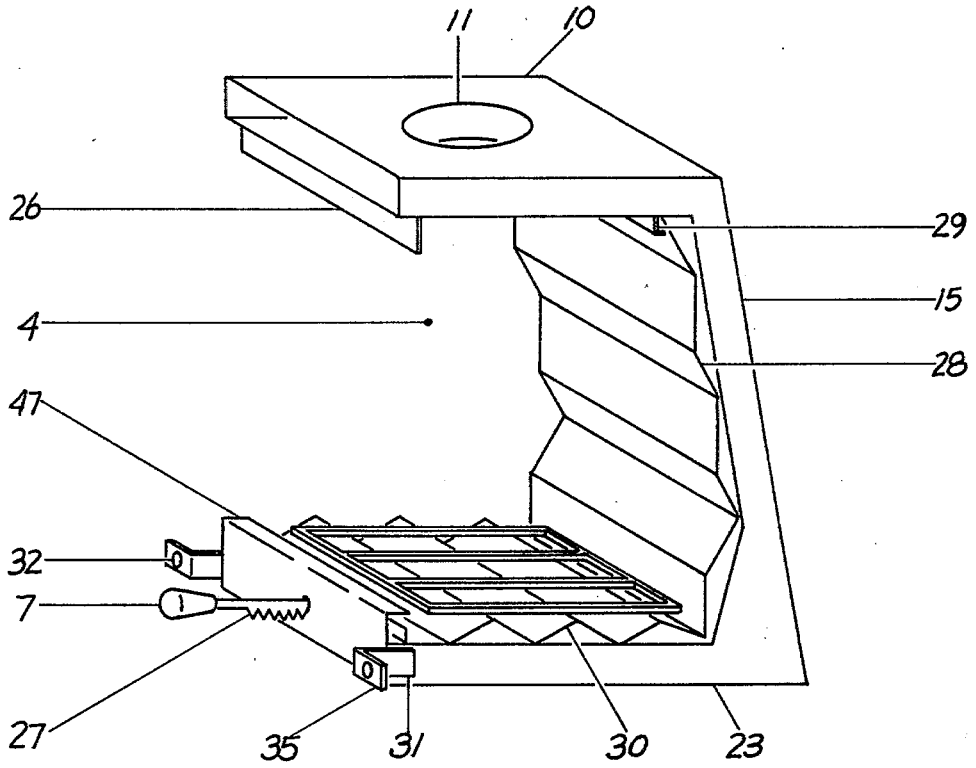
FIG. 8 depicts the combustion chamber portion of the invention.

FIG. 8 depicts the combustion chamber (4) of the invention, showing the butterfly valve (8) control handle (7) with the adjustment notches (27) with which to engage the metal skin of the inside frame of the unit (1). It also shows the anchor arms (31) extending from the interior face of the air flow passage (23) along the bottom of the combustion chamber and permanently affixed to either side thereof and each having an area extending perpendicular to the side of and beyond said airflow passage, being each equipped with a hole (32) of sufficient diameter to accept the threaded shank of the attachment bolts (33) extending from the rear of the front frame (1) of the unit.

Figure 9:
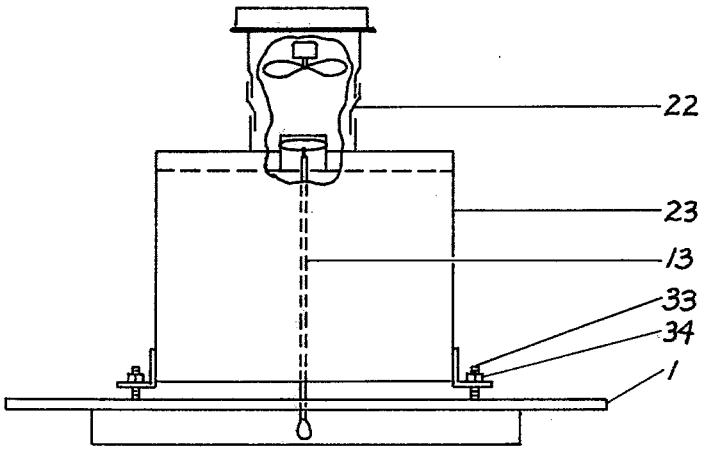
FIG. 9 depicts a cross-sectional bottom view of the fireplace heat exchanger system, as installed.

FIG. 9 depicts a cross-sectional bottom view of the fireplace heat exchanger system as installed, showing the attachment bolts (33) welded to and extending rearward from the interior frame of the unit (1) and being inserted through the holes (32) in the arms (35) perpendicular to the side of the airflow passage under the burn chamber (4) and adjustably secured thereto by nuts (34) tightened on their threaded shanks. This method of attachment in conjunction with the forced-air outlet sleeve (9) on the top rear of the interior frame (1) facilitates adaptation of this unit to fireplaces of varying depths.

Figure 10:
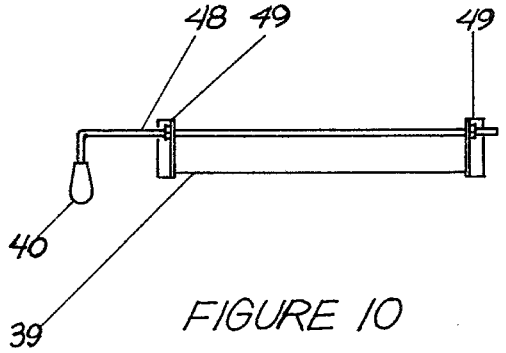

FIG. 10 depicts the forced-air damper (39) fixedly attached to a control rod (48) along its top, which rod is rotatably affixed to a guide plate anchored on the left side to the interior frame (1) and threaded through a guide plate (49), similarly attached to the interior frame (1) on the right side of the air vent (6), terminating in a handle (40) affixed 90 degrees to the axis of rotation of the control rod (48). Said guide plates (49) being of such a distance apart so as to constrict the free movement of the damper (39) to such a degree that the friction created thereby will not allow gravity to rotate the damper (39) rod (48) from its position, while said friction is capable of being overcome by reasonable manual pressure on the handle (40).

I claim:

1. In a fireplace combustion chamber having an adjustable forced air heating insert forming a heat exchanger means, a telescoping dual intake chamber with an outside source of ambient air, a cover for the front of the existing fireplace combustion chamber having a forced air outlet in an upper portion thereof an sleeve means for telescopically connecting said air outlet to said heat exchanger means, a means to control the amount and velocity of outside air entering the combustion chamber and the amount of outside air entering the heat exchanger, and means for guarding the front cover and the heat exchanger means from flame damage comprising:

(a) a heat exchanger having a hollow rectangular air chamber extending in a continuous fashion from a position adjacent the forced-air outlet on the cover across the top of the combustion chamber and down its rear face communicating into a top section of a duel intake chamber which communicates with an outside source of ambient air through a lower portion of the rear wall of the fireplace combustion chamber, said top portion of the heat exchanger having a cylindrical channel therein of less diameter than the width of the heat exchanger, perpendicular to and through its height at the center of the portion spanning the top of the fireplace combustion chamber, open at both its ends with its side impervious to air to define a channel through which exhaust gas from the combustion chamber pass to the chimney flue of the existing fireplace, said heat exchanger has an external removable means associated with the combustion chamber side of the heat exchanger for the protection thereof;

(b) an airtight cover for the front of the existing fireplace combustion chamber having a means for attachment to the frontal surface of the existing fireplace so that air cannot pass from the interior of the structure into the combustion chamber of the existing fireplace, said cover is equipped with self-closing means for access to the combustion chamber, for insertion of fuel materials, a lever extending through said cover and connected to an air flow control means which is operatively associated with said dual intake chamber to control the rate of burn within the combustion chamber, said sleeve which communicates with the forced air outlet extending rearward along the top of the combustion chamber and is of such outside dimension as to fit telescopingly inside the portion of said heat exchanger extending across the top of the combustion chamber so that the effective length of this top portion of the heat exchanger is variable by inserting or retracting this sleeve, a means for blocking the passage of air through said outlet is connected to said cover andjacent said forced air outlet, and means to guard the frontal cover from flame damage is connected to that portion of the heat exchanger extending across the top of the combustion chamber;

(c) said dual intake chamber has a telescoping portion which inserted between the exterior wall of the existing fireplace and the lower rear surface of the combustion chamber and is covered on the exterior wall of the fireplace by a louvered screen and rain hood which is secured by suitable means to the exterior wall, a variable speed intake fan is located in the telescoping portion of the dual intake chamber for introducing outside ambient air into the heat exchanger means and for introducing air for combustion into a combustion chamber intake channel means, said combustion chamber intake channel means is comprised of an air chamber which is located adjacent the bottom of the combustion chamber and which extends across the full width thereof, said combustion chamber intake channel communicates at the rear side thereof with the dual intake chamber, the front side of said combustion chamber intake channel introduces the air for combustion into the combustion chamber and has means associated therewith to direct the flow of air down and back across the bottom of the combustion chamber while precluding blowback of a flame into said combustion chamber intake channel, said flow control means comprises a butterfly damper which is located between said intake fan and the rear side of said combustion chamber intake channel and which is of such a size as to be capable of closing off the combustion chamber intake channel completely 2. The adjustable forced-air fireplace heating insert as described in claim 1 wherein the means of attachment of the cover to the frontal surface of the existing fireplace has a standard insulation material between an overlapping face of the cover and the frontal surface of the existing fireplace and said cover is secured airtightly by concrete bolts to the frontal surface of the fireplace.

3. The adjustable forced-air fireplace heating insert as described in claim 1 wherein the self-closing means of access from the interior of the dwelling structure to the combustion chamber through the cover is a pair of opposing heat-tempered ¼" glass doors with ¼" flat stock mill steel frames, rotatably attached to an interior frame of the cover by means of two hinges having a top half permanently affixed to the glass door frame and the bottom half affixed to the interior frame, held in vertical alignment by a rotational hingepin threaded inside the top and bottom halves, with adjoining faces of the hinge halves parallel when closed and cut at an angle downward from the outside toward the glass and of a sufficient angle so that the adjoining face of the top half rides up on the adjoining face of the bottom half when the door is opened.

4. The adjustable forced-air fireplace heating insert as described in claim 1 wherein the means of guarding the frontal surface from damage by flame traveling across the combustion chamber, is a metal plate of suitable length extending downward from said top portion of said heat exchanger and extending the width of the heat exchanger.

5. The adjustable forced-air fireplace heating insert as described in claim 1 wherein the means of blocking the flow of air through the forced-air outlet on the face of the cover to the combustion chamber is an impervious damper extending over the air outlet from a control rod along its top length, which rod is rotatably affixed to a guide plate at either end of the damper, which plates restrict the rotation of the damper by friction, which is manually overridable by movement of the handle affixed at the end of the control rod.

6. The adjustable forced-air fireplace heating insert as described in claim 1 wherein the external removable means is a horizontally-corrogated metal sheet, allowing air chambers between it and and the combustion side of the rear heat exchanger, being held nonattachedly in place by a short section of angle iron extending downward from the rear undersurface of the top heat exchanger, across its width, with its bottom edge resting on the top of the combustion chamber intake channel, said bottom edge being nonattachedly held in place by a similar corrogated metal sheet, and a removable corrugated metal sheet covering the top surface of the combustion chamber intake channel.

7. The adjustable forced-air fireplace heating insert as described in claim 1 wherein said telescoping dual intake chamber is comprised of a first sleeve attached to the rear surface of the dual intake chamber and is in communication with said heat exchanger; a second sleeve of smaller diameter than said first sleeve communicates with the ambient exterior air source and contains said variable speed intake fan and is so arranged as to fit telescopingly inside of said first sleeve for allowing the length of the two sleeves to change without losing the continuity from the ambient air source to the dual intake chamber.

8. The adjustable forced-air fireplace heating insert as described in claim 1 wherein said lever has a mechanical means of positively controlling the position of the butterfly damper in the combustion chamber intake channel and is formed of a ¼" steel shaft permanently and rotatably attached to the base of the butterfly valve, extending through the length of the airflow intake channel on the floor of the combustion chamber, and terminating in a handle beyond the cover of the fireplace a lower face of the shaft immediately adjacent to the handle is equipped with a series of notches which engage the edge of a slot in the cover through which the shaft extends, thereby holding the shaft in the selected position.

9. The adjustable forced-air fireplace heating insert as described in claim 1 wherein the means to direct the airflow from the combustion chamber intake channel is a rectanguiar metal chamber communicating with the intake channel and having a member which extends beyond and is folded rearward above and parallel to the top side of the combustion chamber intake chamber, without touching said top side.

10. The adjustable forced-air fireplace heating insert as described in claim 1 wherein said combustion chamber intake channel is adjustably attached to the cover of the fireplace heating insert by two bolts welded to either side of the rear of the cover with threaded shanks extending toward the bottom airflow intake channel and communicating with bolt holes provided in metal plates extending perpendicular to the sides of the airflow intake channel, being secured thereto by suitable nuts.

* * * * *